US009272411B1

(12) United States Patent
Whiteside

(10) Patent No.: US 9,272,411 B1
(45) Date of Patent: Mar. 1, 2016

(54) MECHANIC'S CREEPER

(71) Applicant: Whiteside Mfg. Co., Delaware, OH (US)

(72) Inventor: Kirt E. Whiteside, Marion, OH (US)

(73) Assignee: Whiteside Mfg. Co., Delaware, OH (US)

( * ) Notice: Subject to any disclaimer, the term of this patent is extended or adjusted under 35 U.S.C. 154(b) by 0 days.

(21) Appl. No.: 14/704,208

(22) Filed: May 5, 2015

(51) Int. Cl.
*B25H 5/00* (2006.01)

(52) U.S. Cl.
CPC ..... *B25H 5/00* (2013.01)

(58) Field of Classification Search
CPC ..... B25H 5/00
USPC ..... 280/32.5, 32.6, 87.01, 87.021, 79.11, 280/79.2; 16/18 CG
See application file for complete search history.

(56) References Cited

U.S. PATENT DOCUMENTS

| | | | | |
|---|---|---|---|---|
| 2,154,952 | A * | 4/1939 | Mahloch | B25H 5/00 188/5 |
| 3,166,780 | A * | 1/1965 | Schultz, Jr. | B60B 33/0002 16/18 CG |
| 5,624,126 | A * | 4/1997 | Vosbikian | B25H 5/00 280/32.6 |
| D396,920 | S | 8/1998 | Whiteside et al. | |
| D398,433 | S | 9/1998 | Whiteside et al. | |
| D401,724 | S | 11/1998 | Whiteside et al. | |
| D403,822 | S | 1/1999 | Whiteside et al. | |
| 6,705,622 | B2 | 3/2004 | Whiteside | |
| 7,032,909 | B2 * | 4/2006 | Lensing | B25H 5/00 280/32.6 |
| D522,707 | S | 6/2006 | Obbitts et al. | |
| 8,403,524 | B2 * | 3/2013 | Prosey | F21S 4/003 280/32.6 |
| 2011/0227302 | A1 * | 9/2011 | Gillespie | B25H 5/00 280/32.6 |

* cited by examiner

*Primary Examiner* — John Walters
(74) *Attorney, Agent, or Firm* — Renner, Kenner, Greive, Bobak, Taylor & Weber

(57) ABSTRACT

A creeper (10) includes a longitudinally extending pad (11) having a body portion (12), a headrest (13) at one end of the body portion (12) and an extension (14) at the other end of the body portion (12). A frame (15) carries the pad (11) and includes longitudinally extending laterally spaced side rails (16, 17) positioned at the lateral periphery of the pad body portion (12), and laterally extending longitudinally spaced cross rails (18, 19) positioned at the longitudinal periphery of the pad body portion (52). Support rails (21, 22) are carried by the cross rails (18, 19) and are positioned at the periphery of the headrest (13) and at the periphery of the pad extension (14), respectively. Caster assemblies (25) are located outside of the profile of the pad (11), and a cover (30) is positioned over each caster assembly (25). The caster assemblies (25) are attached to the cover (30) with an extension (34) of the side rails (16, 17) positioned therebetween.

16 Claims, 3 Drawing Sheets

MECHANIC'S CREEPER

TECHNICAL FIELD

This invention relates to a creeper such as used by mechanics when servicing vehicles. More particularly, this invention relates to a creeper which is stable having its caster assemblies outboard of the pad while at the same time being protected.

BACKGROUND ART

Most mechanic's creepers have a frame which carries a pad and a plurality of caster assemblies to render the creeper mobile. Oftentimes the caster assemblies are located under the pad. However, such a configuration can result in an unstable creeper. As such, creepers have been designed with the caster assemblies being exposed outboard of the profile of the pad. While such provides more stability to the creeper, the exposed caster assemblies are not only subject to being damaged, but they also create a possible hazard for snagging onto items such as the clothing of the user.

Other stability problems arise with creepers having their caster assemblies under the pad inasmuch as a reasonably significant portion of the pad extends laterally outwardly from the frame which is carrying the casters. As a result, any substantial weight of the user placed on this portion of the pad could cause the creeper to laterally tip.

Thus, the need exists for a creeper which is stable while at the same time not exposing the caster assemblies.

DISCLOSURE OF THE INVENTION

It is thus an object of one aspect of the present invention to provide a creeper in which the caster assemblies are located outside of the profile of the pad and are yet protected.

It is an object of another aspect of the invention to provide a creeper, as above, with covers positioned over the outbound caster assemblies.

It is an object of an additional aspect of the invention to provide a creeper, as above, which utilizes a single connection to attach the caster assemblies to the cover and to the frame of the creeper.

It is an object of yet another aspect of the invention to provide a creeper, as above, with a frame located around the entire periphery of the pad that it is carrying.

These and other objects of the present invention, as well as the advantages thereof over existing prior art forms, which will become apparent from the description to follow, are accomplished by the improvements hereinafter described and claimed.

In general, a creeper made in accordance with one aspect of the present invention includes a frame and a pad carried by the frame. Caster assemblies are located outside of the profile of the pad, and a cover is positioned over each of the caster assemblies.

In accordance with another aspect of the invention, a creeper includes a longitudinally extending pad having a body portion. The pad is carried by a frame which includes longitudinally extending, laterally spaced side rails positioned near the lateral periphery of the body portion of the pad. Laterally extending longitudinally spaced cross rails are positioned near the longitudinal periphery of the body portion of the pad.

In accordance with another aspect of the invention, a creeper includes a longitudinally extending pad carried by a frame having longitudinally extending side rails. A caster assembly is located near each longitudinal end of said side rails and a cover is positioned over each caster assembly. The caster assemblies are attached to the cover with the longitudinal ends of the side rails positioned therebetween.

When all of these aspects are combined, a creeper made in accordance with the present invention includes a longitudinally extending pad having a body portion. A frame carries the pad and includes longitudinally extending, laterally spaced side rails positioned near the lateral periphery of the body portion of the pad, and laterally extending, longitudinally spaced cross rails positioned near the longitudinal periphery of the body portion of the pad. A caster assembly is located outside of the profile of the pad near each longitudinal end of the side rails. A cover is positioned over each caster assembly. The caster assemblies are attached to the cover with the longitudinal ends of the side rails positioned therebetween.

A preferred exemplary creeper made in accordance to the concepts of the present invention is shown by way of example in the accompanying drawings without attempting to show all the various forms and modifications in which the invention might be embodied, the invention being measured by the appended claims and not by the details of the specification.

PREFERRED EMBODIMENT FOR CARRYING OUT THE INVENTION

Figure 1:
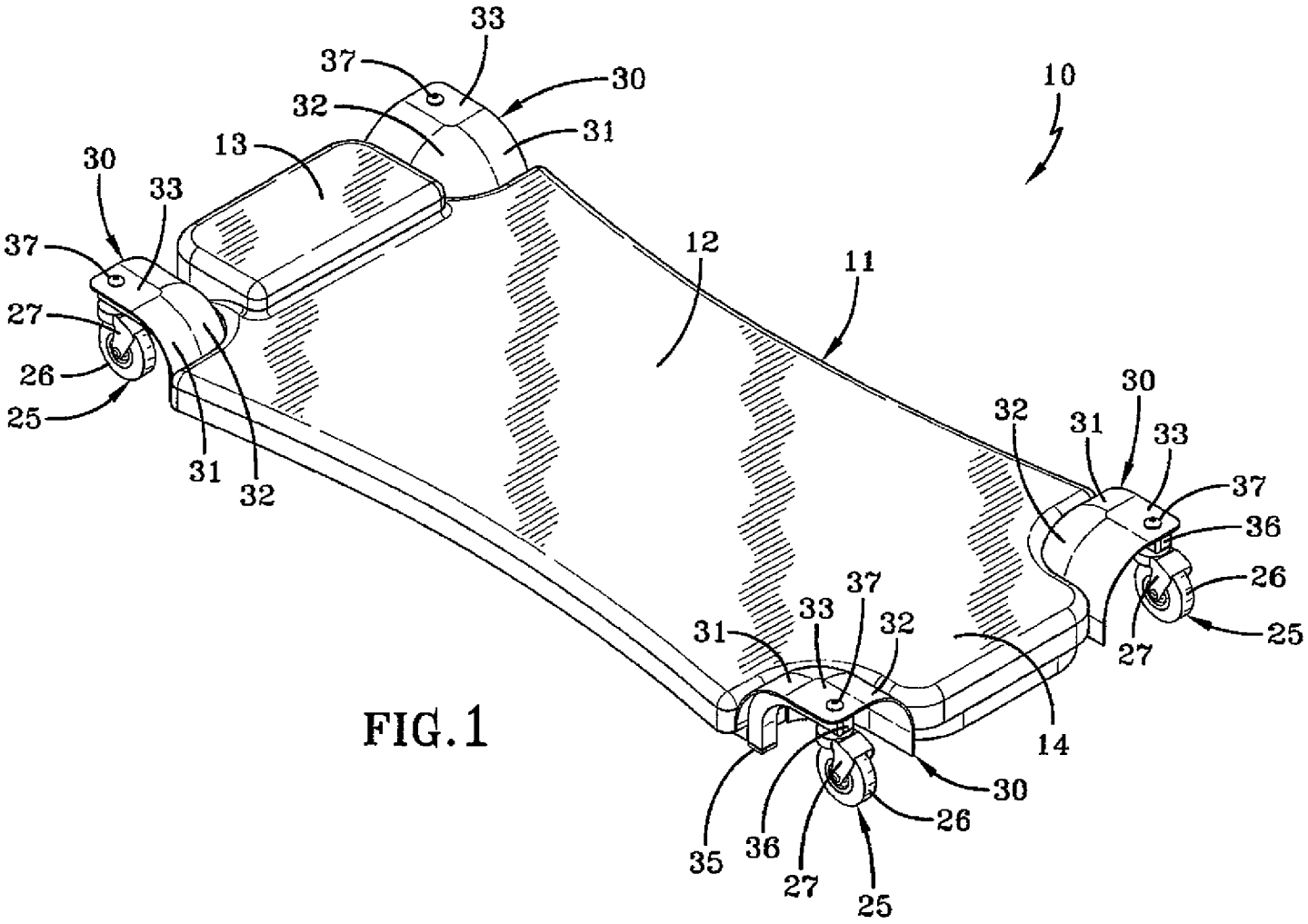
FIG. 1 is a perspective view of a creeper made in accordance with the present invention.

A creeper made in accordance with the concepts of the present invention is indicated generally by the numeral 10. Creeper 10 includes a pad, generally indicated by the numeral 11, having a longitudinally extending body portion 12 and a raised headrest portion 13 positioned at one longitudinal end of pad body portion 12. A pad extension 14 extends longitudinally outward from the other end of pad body portion 12. As shown, the lateral edges of body portion 12 may be inwardly bowed at the center thereof.

Figure 2:
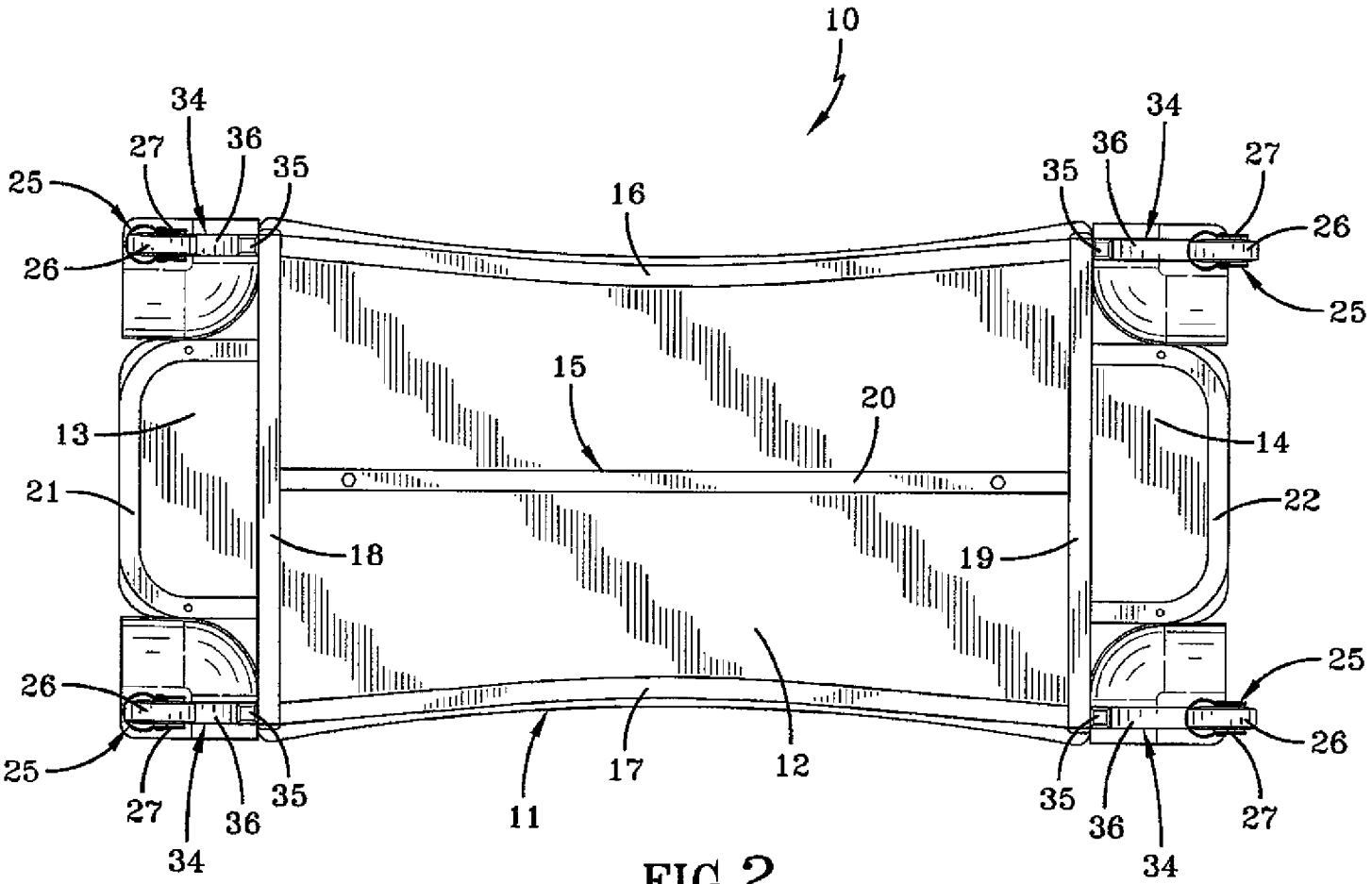
FIG. 2 is a bottom plan view thereof.
Figure 3:
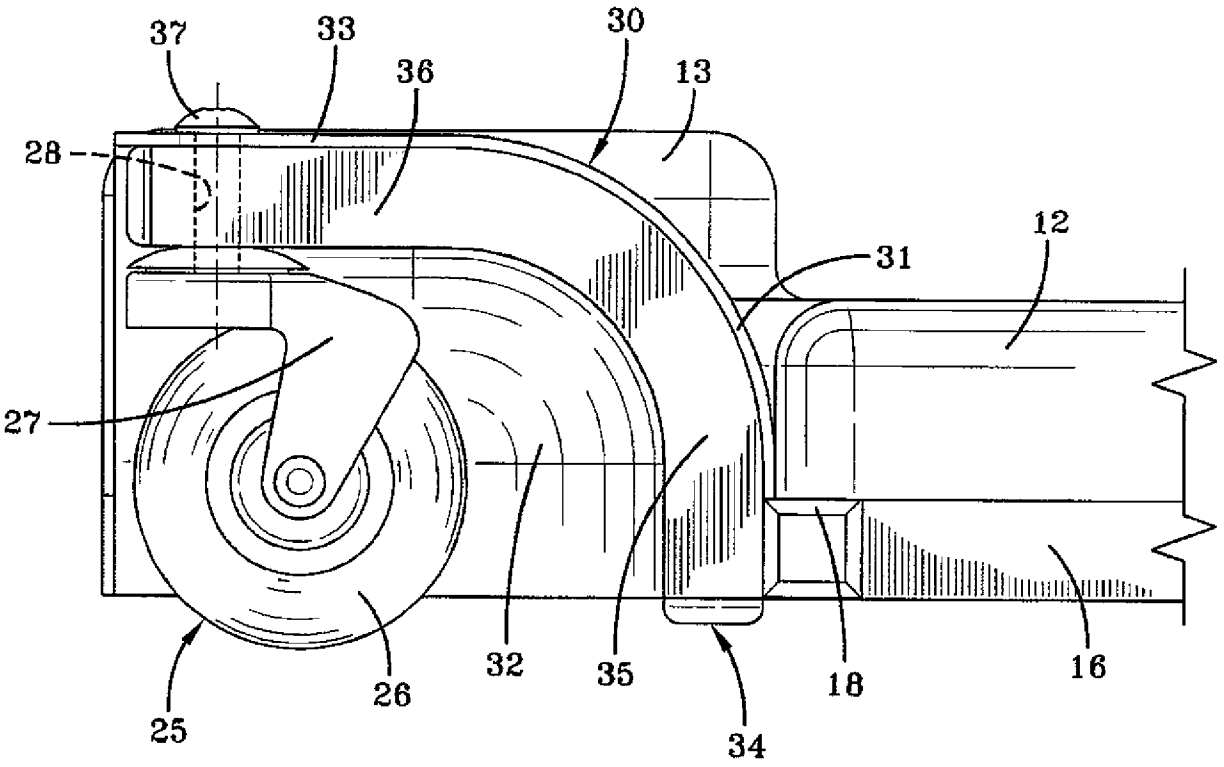
FIG. 3 is a fragment side view showing, in particular, one of the caster assemblies.

As shown in FIG. 2, pad 11 is carried by a frame generally indicated by the numeral 15. Frame 15 is preferably made of a metallic material in the form of the tubes and includes longitudinally extending, laterally spaced, side rails 16, 17 located at or very near to the lateral edges of body portion 12 of pad 11. As shown in FIG. 2, side rails 16, 17 may be inwardly bowed at the center thereof so as to closely conform to the shape of the lateral edge of pad body portion 12. Frame 15 also includes laterally extending, longitudinally spaced, cross rails 18, 19 attached to side rails 16, 17 at the ends thereof. A longitudinally extending rail 20 may be provided under generally the lateral center of pad body portion 12 and is attached at each end to cross rails 18, 19. Frame 15 also includes a C-shaped headrest support rail 21 which is attached to cross rail 18 and which extends around the entire periphery of pad headrest portion 13. An additional C-shaped support rail 22 is attached to cross rail 19 and extends around the entire periphery of pad extension 14. As such, the entire periphery of pad 11 is supported at its periphery by side rails 16, 17, cross rails 18, 19, and and support rails 21 and 22.

Caster assemblies, generally indicated by the numeral 25, are located laterally outside of each side of headrest 13 and laterally outside of each side of pad extension 14. As such, the caster assemblies are located outside of the peripheral profile of pad 11. Each caster assembly 25 includes a wheel 26 rotatably carried by a bracket 27 which itself rotates on a caster stem 28. A cover, generally indicated by the numeral 30, is provided over each caster assembly 25 to protect the caster assemblies 25 and to protect the user from interference from or with the caster assemblies 25. Each cover includes a generally arcuate side portion 31 which is positioned adjacent to body portion 12 of pad 11 and which can be welded or otherwise attached to cross rails 18 or 19. Each cover also includes a generally arcuate side portion 32 which is positioned adjacent to headrest 13 or pad extension 14 and which can be welded or otherwise attached to support rails 21 or 22. Side portions 31 and 32 intersect each other and extend upwardly to a flat portion 33 directly above each caster assembly 25. Each side rail 16 and 17 includes a curved auxiliary frame extension, generally indicated by the numeral 34, which is provided for each caster assembly 25. Each side rail extension frame 34 includes a branch 35 attached to cross rails 18 and 19, and a second branch 36 extending under flat portion 33 of each cover 30. The stem 28 of each caster assembly 25 extends through branch 36 of frame 34 and through flat portion 33 of each cover 30 to attach the cover 30 and the caster assembly 25 to creeper 10 as by a nut 37 affixed to stem 28. It should be evident that the auxiliary frame 34 extension of the side rails 16, 17 could be eliminated and the side rails 16, 17 configured so as to be attached directly to the cover 30 and caster assemblies 25.

In view of the foregoing, it should be appreciated that a creeper constructed as described herein accomplishes the object of the invention and otherwise substantially improves the art.

What is claimed is:

1. A creeper comprising a frame having side rails with ends, a pad having a profile and carried by said frame, caster assemblies located outside of the profile of said pad and near each end of said side rails, and a cover positioned over each said caster assembly, said caster assemblies being attached to said covers with the ends of said side rails being located between said caster assemblies and said covers.

2. The creeper of claim 1, said pad having a longitudinally extending body portion having lateral and longitudinal peripheries, said frame including longitudinally extending, laterally spaced side rails positioned near the lateral periphery of said body portion of said pad, and laterally extending, longitudinally spaced cross rails positioned near the longitudinal periphery of said body portion of said pad.

3. The creeper of claim 1 wherein said pad includes a body portion with ends, a headrest portion positioned at one end of said body portion and having sides, and an extension positioned at the other end of said body portion and having sides, a said caster assembly and a said cover being located on each side of said headrest portion and a said caster assembly and a said cover being located on each side of said extension.

4. A creeper comprising a frame, a pad having a body portion with a profile and with ends carried by said frame, a headrest portion positioned at one end of said body portion and having sides, and an extension positioned at the other end of said body portion and having sides, caster assemblies located outside of the profile of said body portion of said pad, and a cover positioned over each said caster assembly, a said caster assembly and a said cover being located on each side of said headrest portion and a said caster assembly and a said cover being located on each side of said extension, wherein each said cover includes a first arcuate side adjacent to said body portion and a second arcuate side adjacent to said headrest or said extension, and a generally flat portion connecting said first and second arcuate sides, each said caster assembly being attached to a said flat portion.

5. A creeper comprising a longitudinally extending pad having a body portion with lateral and longitudinal peripheries, a frame carrying said pad, said frame including longitudinally extending, laterally spaced side rails having longitudinal ends and being positioned near the lateral periphery of said body portion of said pad, and laterally extending, longitudinally spaced cross rails positioned near the longitudinal periphery of said body portion of said pad, a caster assembly located near each longitudinal end of said side rails, and a cover positioned over each said caster assembly, said caster assemblies being attached to said covers with the longitudinal ends of said side rails being located between said caster assemblies and said covers.

6. The creeper of claim 5, said frame further including a longitudinally extending rail extending between said cross rails and spaced from said side rails.

7. The creeper of claim 5 wherein said body portion has longitudinal ends, and wherein said pad includes a headrest extending from one longitudinal end of said body portion and an extension extending from the other longitudinal end of said body portion.

8. A creeper comprising a longitudinally extending pad having a body portion with longitudinal ends, said pad including a headrest extending from one longitudinal end of said body portion and having a periphery, a frame carrying said pad, said frame including longitudinally extending, laterally spaced side rails positioned near the lateral periphery of said body portion of said pad, laterally extending, longitudinally spaced cross rails positioned near the longitudinal periphery of said body portion of said pad, and a support rail attached to one of said cross rails and extending around the periphery of said headrest.

9. A creeper comprising a longitudinally extending pad having a body portion with longitudinal ends, said pad including an extension extending from one longitudinal end of said body portion and having a periphery, a frame carrying said pad, said frame including longitudinally extending, laterally spaced side rails positioned near the lateral periphery of said body portion of said pad, laterally extending, longitudinally spaced cross rails positioned near the longitudinal periphery of said body portion of said pad, and a support rail attached to one of said cross rails and extending around the periphery of said extension.

10. A creeper comprising longitudinally extending pad having ends, a frame carrying said pad and having longitudinally extending side rails having longitudinal ends, a caster assembly located near each longitudinal end of said side rails, and a cover positioned over each said caster assembly, said caster assemblies being attached to said covers with the longitudinal ends of said side rails being located between said caster assemblies and said covers.

11. The creeper of claim 10 wherein said pad includes a headrest at one end thereof and an extension at the other end thereof, and wherein each said cover includes a first arcuate side adjacent to said pad and a second arcuate side adjacent to said headrest or said extension, and a generally flat portion connecting said first and second arcuate sides, each said caster assembly being attached to a said flat portion.

12. The creeper of claim 11, said frame including longitudinally spaced cross rails extending laterally between said side rails, said first arcuate side of each said cover being attached to a said cross rail.

13. The creeper of claim 12, said frame further including a first support rail at the periphery of said pad headrest and a second support rail at the periphery of said pad extension, said second arcuate side of each said cover being attached to a said support rail.

14. The creeper of claim 12 wherein said side rails include a frame extension having a first branch attached to said cross rails and a second branch under said cover flat portion.

15. The creeper of claim 10 wherein each said caster assembly includes a stem, said stem extending through a said side rail and a said flat portion to attach said caster assembly, said covers, and said frame to each other.

16. A creeper comprising a longitudinally extending pad having a profile and having a body portion with lateral edges and a longitudinal periphery; a frame carrying said pad and having longitudinally extending, laterally spaced side rails having longitudinal ends, a said side rail being positioned near the one lateral edge of said body portion of said pad, and laterally extending, longitudinally spaced cross rails positioned near the longitudinal periphery of said body portion of said pad; a caster assembly located outside of the profile of said pad near each longitudinal end of said side rails; and a cover positioned over each said caster assembly; said caster assemblies being attached to said covers with the longitudinal ends of said side rails between said caster assemblies and said covers.

* * * * *